United States Patent [19]

Iijima et al.

[11] Patent Number: 4,894,097

[45] Date of Patent: Jan. 16, 1990

[54] RARE EARTH TYPE MAGNET AND A METHOD FOR PRODUCING THE SAME

[75] Inventors: Kenzaburou Iijima; Masayuki Takamura; Takeo Sata, all of Hamamatsu, Japan

[73] Assignee: Yamaha Corporation, Shizuoka, Japan

[21] Appl. No.: 140,296

[22] Filed: Dec. 31, 1987

Related U.S. Application Data

[62] Division of Ser. No. 694,336, Jan. 24, 1985.

[51] Int. Cl.[4] ..... H01F 1/02

[52] U.S. Cl. ..... 148/101; 148/103; 148/105; 148/108

[58] Field of Search ..... 148/101, 103, 104, 105, 148/108

[56] References Cited

U.S. PATENT DOCUMENTS

| | | | |
|---|---|---|---|
| 4,533,408 | 8/1985 | Koon | 148/103 |
| 4,597,938 | 7/1986 | Matsuura et al. | 148/105 |
| 4,601,875 | 7/1986 | Yamamoto et al. | 148/104 |
| 4,723,994 | 2/1988 | Ovshinsky et al. | 148/105 |

FOREIGN PATENT DOCUMENTS

| | | | |
|---|---|---|---|
| 116844 | 7/1981 | Japan | 148/403 |
| 9104 | 1/1985 | Japan . | |

*Primary Examiner*—John P. Sheehan
*Assistant Examiner*—George Wyszomierski
*Attorney, Agent, or Firm*—Sachs & Sachs

[57] ABSTRACT

In production of rare earth type magnet, addition of Nd to Fe-Gd-metalloid base containing 2 or more of B, Si, and P, combined with solidification of molten alloy by abrupt cooling assures large coercive force and high susceptibility of the product.

11 Claims, 3 Drawing Sheets

RARE EARTH TYPE MAGNET AND A METHOD FOR PRODUCING THE SAME

This application is a Division of Application Ser. No. 694,336 filed on Jan. 24, 1985 now pending in the United States Patent and Trademark Office.

BACKGROUND OF THE INVENTION

The present invention relates to an improved rare earth type magnet and a method for producing the same, and more particularly relates to production of high quality alloy magnet containing rare earth elements and well suited for use on electric and/or electronic appliances.

Conventionally, Fe-Al-Ni-Co-(Cu) type alnico magnets have been widely known in the field as alloy magnets of high quality. Despite the relatively high quality, use of alnico magnets in general connects to high production cost due to the content of expensive Co. In addition, advantages accruing from such high quality do not in practice outweigh disadvantages resulting from such high production cost. Like alnico magnets, production of Fe-Cr-Co type alloy magnets has recently been developed, which utilizes so-called spinodal transformation. Despite the higher quality than that of alnico magnets, the large content of Co in such type of alloy magnets again causes rise in production cost. Further, the quality of such type of alloy magnets is not high enough to fully suffice various demands on magnet quality increasingly raised in recent developments in the field of electronic engineering. In these circumstances, development of new alloy magnets of further advanced quality is strongly expected in the field.

Use of alloy magnets containing rare earth elements, in particular ferror-rare earth element type magnets, has recently been proposed. For example, an alloy magnet containing Fe and Gd and a metalloid element or elements such as B, has already been developed by use of a melt-casting method. When produced by the ordinary melt-casting method, however, the coercive force (iHc) of such a type of alloy magnet is in a range from 100 to 200 Oe and the magnetic susceptibility in a range from 15 to 30 emu/gr. The significantly lower levels of these magnetic characteristics disenable use of the alloy magnet of this type in practice.

SUMMARY OF THE INVENTION

It is the object of the present invention to produce an improved rare earth type magnet having extra high quality well suited for practical use on electric and electronic appliances such as, in particular, high level of coercive force.

In accordance with one basic aspect of the present invention, a rare earth type magnet contains Fe, Gd, Nd and at least one metalloid element chosen from a group consisting of B, Si and P at an atomic ratio defined by $(Fe_{1-x}M_x)_y(Gd_zNd_{1-z})_{1-y}$ wherein x is in a range from 0.05 to 0.4, y is in a range from 0.7 to 0.95, z is in a range from 0.05 to 0.8 and M is the total of a metalloid element or elements chosen from the group.

In accordance with another basic aspect of the present invention, a molten alloy of the above-described composition is subjected, after solidification by cooling, to annealing at a temperature in a range from 400° to 950° C.

In accordance with the other basic aspect of the present invention, a molten alloy of the above-described composition is subjected, after solidification by cooling, to pulverization, the pulverized alloy is subjected to compaction in a magnetic field for shaping, and the shaped alloy is further subjected to hot hydrostatic compaction at a temperature in a range from 600° to 1000° C.

DESCRIPTION OF THE PREFERRED EMBODIMENTS

Figure 1:
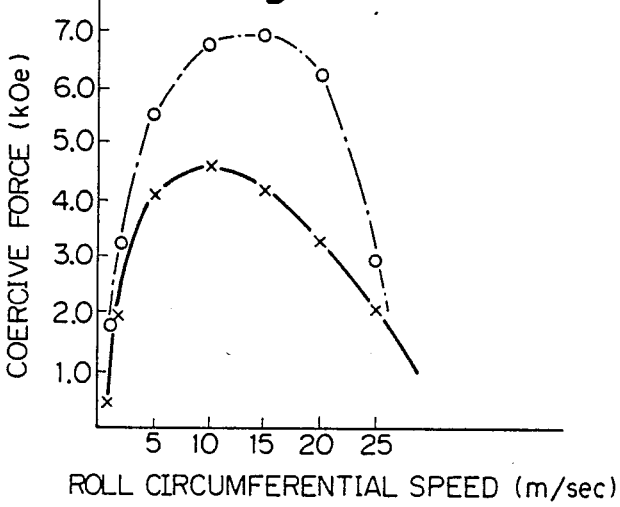
FIG. 1 is a graph for showing the relationship between roll circumferential speed and resultant coercive force (iHc) after solidification by abrupt cooling and after annealing, respectively, for a molten alloy having a composition defined by $(Fe_{0.8}B_{0.2})_{0.85}(Gd_{0.5}Nd_{0.5})_{0.15}$.

In accordance with the present invention, the molten alloy of the above described composition and containing metalloid element or elements is first solidified by cooling, and more preferably by abrupt liquid cooling. At abrupt liquid cooling, molten alloy is ejected from a nozzle onto the surface of a metallic rotary body or bodies cooled, for example, by application of water to obtain an alloy strap. Ordinary abrupt liquid cooling includes disc method, single roll method and dual roll method. The single roll method is most advantageously employed in the case of the present invention, in which molten alloy is ejected onto the surface of a single rotary roll. When water is used for cooling, the circumferential speed of the rotary roll should preferably be in a range from 2.0 to 25 m/sec. As later clarified in more detail in reference to FIG. 1, any circumferencial speed falling out of this range would lower the coercive force (iHc) of the product. When molten alloy is solidified by abrupt cooling within this speed range, the resultant coercive force (iHc) is in a range from 3 to 5 kOe and the magnetic susceptibility in a range from 15 to 40 emu/gr. Such solidification by abrupt cooling develops an amorphous or extremely fine crystal state in the product, which is instrumental in enhancing the magnetic characteristics of the product.

As remarked above, the present invention is characterized by content of Fe, Gd, Nd and at least one or more metalloid elements at the specified atomic ratio defined by $(Fe_{1-x}M_x)_y(Gd_zNd_{1-z})_{1-y}$. First, the value of x, which specifies the atomic ratio between Fe and the metalloid elements, should be in a range from 0.05 to 0.4. Any value falling short of this lower limit would not assure practically sufficient level of coercive force (iHc) whereas any value exceeding this upper limit would not assure practically sufficient level of magnetic susceptibility ($\sigma$). Second, the value of z, which specifies the atomic ratio between Gd and Nd, should be in a range from 0.05 to 0.8. Any value falling outside this range would not assure practically sufficient level of coercive force (iHc). Thirdly, the value y, which specifies the atomic ratio between the Fe-metalloid group and the Gd-Ne group, should be in a range from 0.7 to 0.95. Any value below this range would not assure practically sufficient level of magnetic susceptibility ($\sigma$) whereas any value above this range would not assure practically sufficient level of coercive force. For these reasons, the value of x should be in a range from 0.05 to 0.4, the value of y in a range from 0.7 to 0.95 and the value z in a range from 0.05 to 0.8. For further betterment of the resultant magnetic characteristics, the value of x should preferably in a range from 0.1 to 0.3, the value of y preferably in a range from 0.75 to 0.9 and the value of z preferably in a range from 0.2 to 0.7. Further, B, Si and P as the metalloid elements may be used either solely or in combination.

Further in accordance with the present invention, the solidified alloy is then subjected to annealing at a temperature in a range from 400° to 950° C. within innert gas atmosphere or vacuum. This annealing causes separation of fine intermediate stable phase which enhances magnetic characteristics, in particular coercive force (iHc), of the product.

Figure 6:
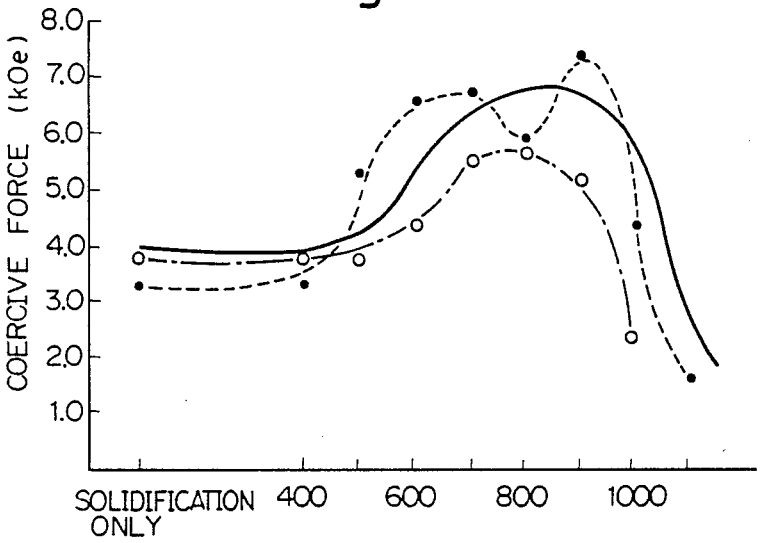
FIG. 6 is a graph for showing the relationship between annealing temperature and resultant coercive force (iHc) in the method of the present invention.

When the annealing temperature is lower than 400° C., there is no appreciable rise in coercive force (iHc) as best seen in FIG. 6, and no effect of annealing is observed. Excess of the annealing temperature over 950° C. causes significant fall in coercive force (iHc). For these reasons, the employable annealing temperature should be in a range from 400° to 950° C. Whereas annealing period should preferably be in a range from 0.2 to 5.0 hours. Any annealing period shorter that the lower limit would not assure sufficient annealing effect whereas any annealing period longer than the upper limit would accompany no corresponding rise in coercive force (iHc).

After the solidification by cooling, the solidified alloy may be subjected to pulverization also. Preferable grain size of the pulverized alloy should preferably be in a range from 2 to 50 $\mu$m. The pulverized alloy is then subjected to compaction within a DC magnetic field of 5000 G or more intensity. By such compaction in a magnetic field, the powder particles in the shaped alloy are oriented in the direction of magnetic induction.

Next, the shaped alloy is subjected to hot hydrostatic compaction in argon gas atmosphere or vacuum at a temperature in a range from 600° to 1000° C. and at a pressure of 1000 kg/cm$^2$ or higher, and more preferably at a pressure in a range from 1000 to 2000 kg/cm$^2$. By this compaction, the obtained magnet is provided with magnetic anisotropy in the direction of the powder particle orientation.

Fall in coercive force (iHc) is observed when the grain size of the pulverized alloy falls outside the above-described range. When the magnetic field intensity at pulverization falls short of 5000 G, no sufficient orientation of the powder particles would follow, thereby causing deficiency in coersive force (iHc) and magnetic susceptibility ($\sigma$). Any temperature at hot hydrostatic compaction below 600° C. would result in insufficient sintering, thereby lowering resultant magnetic characteristics, in particular magnetic susceptibility ($\sigma$). Wheres any temperature above 1000° C. would cause dissolution of the material, thereby impairing the effect of the initial solidification by cooling. Any pressure at hot hydrostatic compaction would connect to insufficient sintering, thereby lowering resultant coercive force (iHc) and magnetic susceptibility ($\sigma$).

EXAMPLES

Example 1

Figure 2:
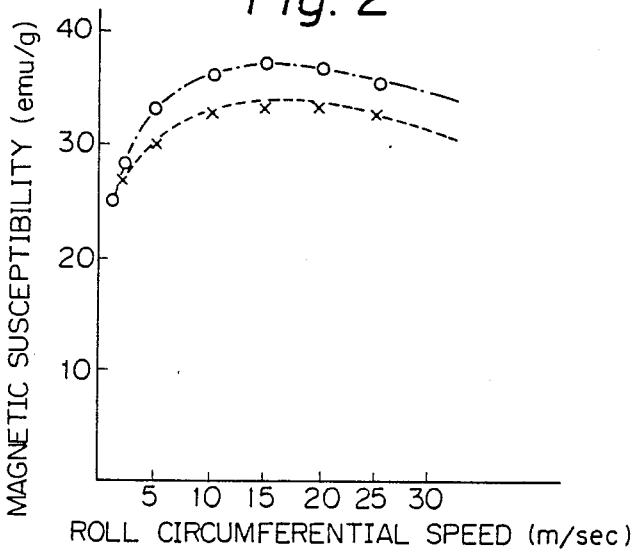
FIG. 2 is a graph for showing the relationship between roll circumferential speed and resultant magnetic susceptibility ($\sigma$) after solidification by abrupt cooling and after annealing, respectively.

As shown in Table 1, molten alloys (Samples 1 to 13) of $(Fe_{0.8}M_{0.2})_{0.85}(Cd_{0.2}Nd_{0.8})_{0.15}$ compositions were prepared in a high-frequency dissolving furnace filled with argon gas whilst using B, Si or P as the metalloid component. Each molten metal was ejected from a nozzle of 250 $\mu$m inner diameter onto a roll of 300 mm outer diameter at various roll circumferential speeds for solidification by abrupt cooling. The solidification produced a thin alloy strap of 50 $\mu$m thickness and 5 mm width. A piece of 3 mm length was taken from this alloy strap for magnetic measurement by a vibrating sample magnetization method. Each alloy strap was then annealed at 85° C. temperature for 1 hour within argon gas atmosphere and, therefore, subjected to similar magnetic measurement. The magnetic characteristics just after the soldification by abrupt cooling and after the annealing are shown in Table 1 over various roll circumferential speeds at the solidification. The resultant coercive force (iHc) and magnetic susceptibility ($\sigma$) of molten alloys containing B as the metalloid component are shown in FIGS. 1 and 2, respectively, over various roll circumferential speeds. In the drawings, the roll circumferential speed is taken on the abscissa, the solid line curves are for the samples just after the solidification by abrupt cooling and the chain line curves are for the samples after the annealing. The coercive force (iHc) is taken on the ordinate in FIG. 1 and the magnetic susceptibility ($\sigma$) is taken on the ordinate in FIG. 2.

TABLE 1

| Sample No | Composition (atomic ratio) | Roll circumferential speed (m/sec) | after solidification: Coercive force (kOe) | after solidification: Magnetic susceptibility (emu/g) | after annealing: Coercive force (kOe) | after annealing: Magnetic susceptibility (emu/g) |
|---|---|---|---|---|---|---|
| 1 | $(Fe_{0.8}B_{0.2})_{0.85}$ | 1 | 0.5 | 25.0 | 1.8 | 25.0 |
| 2 | | 2 | 2.0 | 27.0 | 3.3 | 28.0 |
| 3 | $(Gd_{0.2}Nd_{0.8})_{0.15}$ | 5 | 4.1 | 30.2 | 5.5 | 33.0 |
| 4 | | 10 | 4.6 | 33.0 | 6.7 | 36.0 |
| 5 | | 15 | 4.2 | 33.5 | 6.9 | 37.0 |
| 6 | | 20 | 3.3 | 33.5 | 6.2 | 36.5 |
| 7 | | 25 | 2.1 | 33.0 | 3.0 | 35.5 |
| 8 | $(Fe_{0.8}Si_{0.2})_{0.85}$ | 5 | 1.6 | 29.5 | 2.3 | 29.6 |

TABLE 1-continued

| Sample No | Composition (atomic ratio) | Roll circumferential speed (m/sec) | after solidification Coercive force (kOe) | after solidification Magnetic susceptibility (emu/g) | after annealing Coercive force (kOe) | after annealing Magnetic susceptibility (emu/g) |
|---|---|---|---|---|---|---|
| 9 | $(Gd_{0.2}Nd_{0.8})_{0.15}$ | 10 | 3.3 | 32.3 | 4.1 | 33.0 |
| 10 | | 20 | 2.6 | 31.5 | 3.9 | 32.6 |
| 11 | $(Fe_{0.8}P_{0.2})_{0.85}$ | 5 | 1.8 | 31.3 | 2.9 | 32.1 |
| 12 | $(Gd_{0.2}Nd_{0.8})_{0.15}$ | 10 | 3.6 | 34.1 | 4.6 | 34.0 |
| 13 | | 20 | 2.8 | 30.5 | 3.5 | 31.5 |

These experimental data clearly indicate that addition of annealing after solidification by abrupt cooling brings about significant improvement in magnetic characteristics of the product. Further, the data relating to the Samples 1 to 7 well support the fact that lowering of the roll circumferential speed below 2 m/sec causes significant reduction in coercive force (iHc).

Example 2

As shown in Table 2, molten alloys (Samples 14 to 36) of various compositions were prepared in a high-frequency dissolving furnace filled with argon gas. Each molten alloy was ejected from a nozzle of 250 μm inner diameter onto a roll rotated at 15 m/sec circumferential speed for solidification by abrupt cooling. The solidification produced a thin alloy strap of 50 μm thickness and 5 mm width. Ten pieces of each 3 mm length were taken from this alloy strap and stacked together for magnetic measurement by the V.S.M method. Each alloy strap was then annealed at 850° C. temperature for 1 hour within argon gas atmosphere and subjected, thereafter, to similar magnetic measurement. The results are collectively shown in Table 2.

Figure 3:
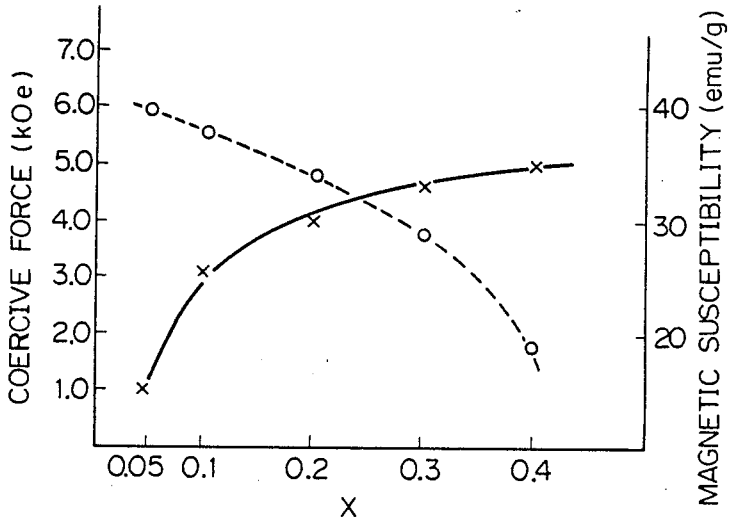
FIG. 3 is a graph for showing the relationship between the value of X and resultant coercive force (iHc) and magnetic susceptibility ($\sigma$) after solidification by abrupt cooling for a molten alloy having a composition defined by $(Fe_{1-x}B_x)_{0.85}(Gd_{0.5}Nd_{0.5})_{0.15}$.

For Samples (Nos. 14 to 18) of $(Fe_{1-x}B_x)_{0.85}(Gd_{0.5}Nd_{0.5})_{0.15}$ compositions, coercive force (iHc) and magnetic susceptibility ($\sigma$) after the solidification by abrupt cooling were measured over various values of x, and the results are shown in FIG. 3, in which the coercive force (iHc) is taken on the left ordinate and the magnetic susceptibility ($\sigma$) is taken on the right ordinate. The solid line is for the coercive force data and the dot line is for the magnetic susceptibility data. The graphical presentation clearly indicates that preferable value of X falls within a range from 0.1 to 0.3.

TABLE 2

| Sample No | Composition (atomic ratio) | Value of X, Y, Z (atomic ratio) | after solidification Coercive force (kOe) | after solidification Magnetic Susceptibility (emu/g) | after annealing Coercive force (kOe) | after annealing Magnetic Susceptibility (emu/g) |
|---|---|---|---|---|---|---|
| 14 | $(Fe_{1-x}B_x)_{0.85}$ | X = 0.05 | 1.0 | 39.0 | 2.5 | 39.0 |
| 15 | $(Gd_{0.5}Nd_{0.5})_{0.15}$ | X = 0.10 | 3.1 | 37.4 | 4.1 | 38.1 |
| 16 | | X = 0.20 | 4.0 | 34.0 | 6.9 | 37.0 |
| 17 | | X = 0.30 | 4.7 | 29.0 | 7.1 | 30.1 |
| 18 | | X = 0.40 | 5.0 | 19.0 | 7.3 | 19.3 |
| 19 | $(Fe_{1-x}Si_x)_{0.85}$ | X = 0.05 | 1.2 | 35.6 | 1.8 | 36.2 |
| 20 | $(Gd_{0.5}Nd_{0.5})_{0.15}$ | X = 0.2 | 3.3 | 34.1 | 7.0 | 35.1 |
| 21 | | X = 0.4 | 6.0 | 17.2 | 8.0 | 18.6 |
| 22 | $(Fe_{1-x}P_x)_{0.85}$ | X = 0.05 | 1.6 | 42.0 | 2.1 | 42.1 |
| 23 | $(Gd_{0.5}Nd_{0.5})_{0.15}$ | X = 0.2 | 3.8 | 39.2 | 5.5 | 40.3 |
| 24 | | X = 0.4 | 6.2 | 21.3 | 6.6 | 23.4 |
| 25 | $(Fe_{0.8}B_{0.2})_y$ | Y = 0.7 | 4.5 | 20.0 | 6.3 | 22.4 |
| 26 | $(Gd_{0.5}Nd_{0.5})_{1-y}$ | Y = 0.8 | 4.2 | 29.0 | 6.1 | 30.6 |
| 27 | | Y = 0.9 | 3.1 | 33.0 | 5.8 | 36.2 |
| 28 | | Y = 0.95 | 2.1 | 35.0 | 4.3 | 40.1 |
| 29 | $(Fe_{0.8}B_{0.2})_{0.85}$ | Z = 0.05 | 1.0 | 41.0 | 2.1 | 40.6 |
| 30 | $(Gd_zNd_{1-z})_{0.15}$ | Z = 0.1 | 1.7 | 40.0 | 3.4 | 41.0 |
| 31 | | Z = 0.3 | 3.5 | 37.0 | 5.6 | 35.2 |
| 32 | | Z = 0.5 | 4.0 | 34.2 | 6.4 | 32.1 |
| 33 | | Z = 0.7 | 3.6 | 29.8 | 6.1 | 28.8 |
| 34 | | Z = 0.8 | 3.0 | 26.3 | 5.9 | 25.3 |
| 35 | $(Fe_{0.85}B_{0.05}Si_{0.05}P_{0.05})_{0.85}(Gd_{0.5}Nd_{0.5})_{0.15}$ | | 4.6 | 42.1 | 7.6 | 40.3 |
| 36 | $(Fe_{0.9}B_{0.02}Si_{0.03}P_{0.05})_{0.95}(Gd_{0.05}Nd_{0.95})_{0.05}$ | | 5.2 | 45.1 | 7.3 | 42.0 |

Figure 4:
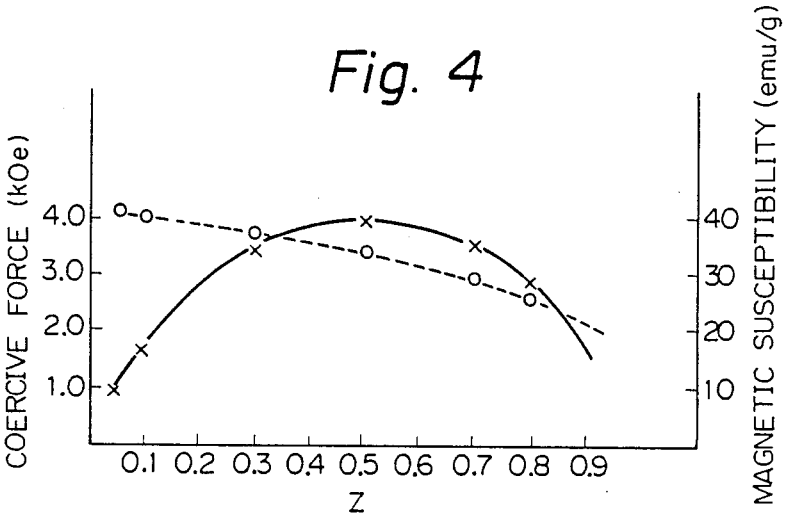
FIG. 4 is a graph for showing the relationship between the value of z and coercive force (iHc) and magnetic susceptibility ($\sigma$) after solidification by abrupt cooling for a molten alloy having a composition defined by $(Fe_{0.8}B_{0.2})_{0.85}(Gd_zNd_{1-z})_{0.15}$.

For Samples Nos. 29 to 34 of $(Fe_{0.8}B_{0.2})_{0.85}(Gd_zNd_{1-z})_{0.15}$ compositions, coercive force (iHc) and magnetic susceptibility ($\sigma$) after the solidification by abrupt cooling were measured over various values of Z, and the results are shown in FIG. 4, in which the coercive force (iHc) is taken on the left ordinate and the magnetic susceptibility ($\sigma$) is taken on the right ordinate. The solid line is for the coercive force data and the dot line is for the magnetic susceptibility data. It is clear from these results that the value of Z shold preferably be in a range from 0.2 to 0.7.

Figure 5:
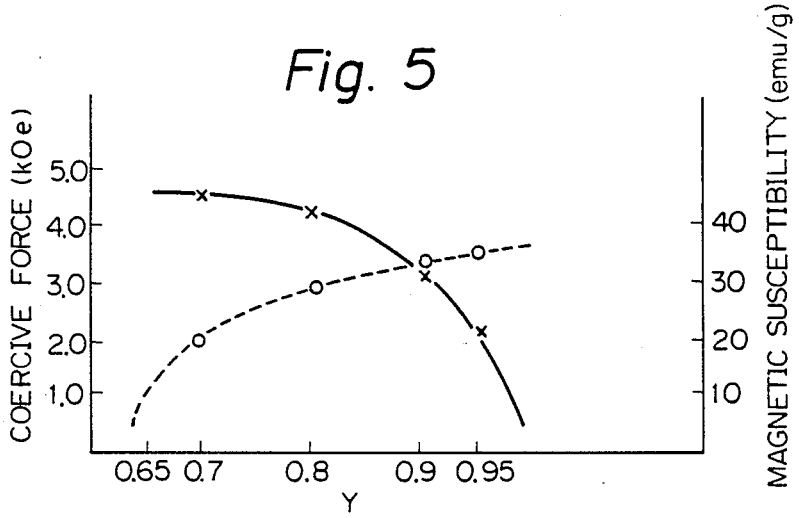
FIG. 5 is a graph for showing the relationship between the value of Y and resultant coercive force (iHc) and magnetic susceptibility ($\sigma$) after solidification by abrupt cooling for a molten alloy having a composition defined by $(Fe_{0.8}B_{0.2})_y(Gd_{0.5}Nd_{0.5})_{1-y}$.

For Samples 25 to 28 of $(Fe_{0.8}B_{0.2})_y(Gd_{0.5}Nd_{0.5})_{1-y}$ compositions, coercive force (iHc) and magnetic susceptibility ($\sigma$) after the solidification by abrupt cooling were measured over various values of Y and the results are shown in FIG. 5, in which the coercive force (iHc) is taken on the left ordinate and the magnetic susceptibility ($\sigma$) is taken on the right ordinate. The solid line is for the coercive force data and the dot line is for the magnetic susceptibility. The results appearing in the graph well supports the preferable range of 0.75 to 0.9 for the value of Y.

Three types of sample straps A, B and C were prepared by solidification by abrupt cooling same as that employed in Example 2. The sample straps A had $(Fe_{0.8}B_{0.2})_{0.85}(Gd_{0.5}Nd_{0.5})_{0.15}$ composition, the sample straps $B(Fe_{0.8}Si_{0.2})_{0.85}(Gd_{0.5}Nd_{0.5})_{0.15}$ composition and the sample straps $C(Fe_{0.8}P_{0.2})_{0.85}(Gd_{0.5}Nd_{0.5})_{0.15}$ composition. The samples A, B and C were subjected to annealing for 1 hour within argon gas atmosphere at various temperatures in a range from 400° to 1100° C. Coercive forces (iHc) after the solidification by abrupt cooling and after the annealing were measured and the results are shown in Table 3 and FIG. 6, in which the coercive force (iHc) is taken on the ordinate. The solid line is for $(Fe_{0.8}B_{0.2})_{0.85}(Gd_{0.2}Nd_{0.8})_{0.15}$ composition data, the dot line for $(Fe_{0.8}Si_{0.2})_{0.85}(Gd_{0.2}Nd_{0.8})_{0.15}$ data and the chain line for $(Fe_{0.8}P_{0.2})_{0.85}(Gd_{0.2}Nd_{0.8})_{0.15}$ data. It is well observed in FIG. 6 that an annealing temperature in a range from 400° to 950° C. results in high level of coercive force.

TABLE 3

| | Change in coercive force (iHc) due to change in annealing temperature | | | | | |
|---|---|---|---|---|---|---|
| | No | Annealing temperature (° C.) | | | | |
| Sample | annealing | 600 | 700 | 900 | 1000 | 1100 |
| A | 4.0 | 5.5 | 6.5 | 6.8 | 5.6 | 2.8 |
| B | 3.3 | 6.5 | 6.8 | 7.4 | 4.4 | 1.8 |
| C | 3.8 | 4.5 | 5.6 | 5.2 | 2.5 | — |

Example 4

The sample straps A, B and C prepared in Example 3 were comminuted to fine particles of 4 to 40 μm grain size and each obtained powdery particles were subjected to compaction at 15000 Kg/cm² pressure in a magnetic field of 20,000 Oe intensity for production of a shaped body. Each shaped body was further subjected to hot hydrostatic compaction at 2000 Kg/cm² argon gas pressure and at various temperatures in a range from 600° to 1000° C. for sintering purposes. Resultant coercive forces (iHc) for various temperatures at the hot hydrostatic compaction are shown in Table 4.

TABLE 4

| | Change in coercive force due to change in hot hydrostatic compaction temperature | | | | | |
|---|---|---|---|---|---|---|
| | Hot hydrostatic compaction temperature (° C.) | | | | | |
| Sample | 600 | 700 | 800 | 850 | 900 | 1000 |
| A | 5.8 | 7.0 | 7.2 | 7.4 | 6.9 | 4.2 |
| B | 6.8 | 7.1 | 7.8 | 8.1 | 7.7 | 4.5 |
| C | 4.8 | 6.3 | 7.4 | 7.3 | 6.1 | 3.3 |

We claim:

1. A method for producing improved rare earth type magnet comprising the steps of preparing molten alloy containing Fe, Gd, Nd and two or more metalloid elements chosen from a group consisting of B, Si and P, at an atomic ratio defined by $(Fe_{1-x}M_x)_y(Gd_zNd_{1-z})_{1-y}$ wherein x is in a range from 0.05 to 0.4, y is in a range from 0.7 to 0.95, z is in a range from 0.05 to 0.8 and M is the total of said two or more metalloid elements, subjecting said molten alloy to solidification by cooling to produce solidified alloy, and subjecting said solidified alloy to annealing at a temperature in a range from 400° to 950° C. to produce a magnet having a coercive force of at least 7.3 KOe and a magnetic susceptibility of at least 40.3 emu/g.

2. A method as claimed in claim 1 in which said annealing is carried out for a period in a range from 0.2 to 5.0 hours.

3. A method as claimed in claim 1 in which said annealing is carried out in inert gas atmosphere.

4. A method as claimed in claim 1 in which said annealing is carried out in vacuum.

5. A method for producing improved rare earth type magnet comprising the steps of preparing molten alloy containing Fe, Gd, Nd and two or more metalloid elements chosen from a group consisting of B, Si and P, at an atomic ratio defined by $(Fe_{1-x}M_x)_y(Gd_zNd_{1-z})_{1-y}$ wherein x is in a range from 0.05 to 0.4, y is in a range from 0.7 to 0.95, z is in a range from 0.05 to 0.8 and M is the total of said two or more metalloid elements subjecting said molten alloy to solidification by cooling to produce solidified alloy, subjecting said solidified alloy to pulverization to produce pulverized alloy, further subjecting said pulverized alloy to compaction in a magnetic field to produce shaped alloy, and further subjecting said shaped alloy to hot hydraulic compaction to produce a magnet having a coercive force of at least 7.3 KOe and a magnetic susceptibility of at least 40.3 emu/g.

6. A method as claimed in claim 5 in which said pulverization is carried out to an extent such that the grain size of the pulverized alloy is in a range from 4 to 40 μm.

7. Method as claimed in claim 5 in which the intensity of said magnetic field at said compaction is 5000 G or higher.

8. Method as claimed in claim 5 in which said hot hydraulic compaction is carried out at a temperature in a range from 600° to 1000° C.

9. Method as claimed in claim 5 in which said hot hydraulic compaction is carried out at a pressure in a range from 1000 to 2000 Kg/cm².

10. Method as claimed in claim 1 or 5 in which said solidification is carried out by liquid abrupt cooling.

11. Method as claimed in claim 10 in which said liquid abrupt cooling is carried out by ejecting said molten alloy onto the surface of a rotary roll whose circumferential speed is in a range from 2.0 to 25 m/sec.

* * * * *